US006846070B2

(12) United States Patent
Jones et al.

(10) Patent No.: US 6,846,070 B2
(45) Date of Patent: Jan. 25, 2005

(54) PRESSURIZED INK FILLING METHOD FOR DUAL COMPARTMENT INK-JET CARTRIDGE USED IN INK-JET PRINTER

(75) Inventors: Bruce S. Jones, Franklin, TN (US); Stephen A. Anderson, Thompson Station, TN (US); Carl D. Massey, Tomball, TX (US); Patrick D. Carter, Fairview, TN (US); William A. Putman, Franklin, TN (US)

(73) Assignee: Nu-kote International, Inc., Franklin, TN (US)

( * ) Notice: Subject to any disclaimer, the term of this patent is extended or adjusted under 35 U.S.C. 154(b) by 0 days.

(21) Appl. No.: 10/149,105

(22) PCT Filed: Oct. 5, 2001

(86) PCT No.: PCT/US01/31258

§ 371 (c)(1),
(2), (4) Date: Jun. 6, 2002

(87) PCT Pub. No.: WO02/28715

PCT Pub. Date: Apr. 11, 2002

(65) Prior Publication Data

US 2002/0191057 A1 Dec. 19, 2002

Related U.S. Application Data

(60) Provisional application No. 60/239,088, filed on Oct. 6, 2000.

(51) Int. Cl.[7] ..... B41J 2/175
(52) U.S. Cl. ..... 347/85; 347/86
(58) Field of Search ..... 347/85, 86, 87, 347/92

(56) References Cited

U.S. PATENT DOCUMENTS

| | | | | | |
|---|---|---|---|---|---|
| 5,317,339 | A | * | 5/1994 | Braun et al. | 347/87 |
| 5,421,658 | A | * | 6/1995 | Suzuki et al. | 400/124.1 |
| 5,504,510 | A | * | 4/1996 | Miyakawa et al. | 347/85 |
| 5,875,615 | A | | 3/1999 | Ito et al. | |
| 5,909,231 | A | * | 6/1999 | Childers et al. | 347/92 |
| 5,936,650 | A | * | 8/1999 | Ouchida et al. | 347/89 |
| 5,946,015 | A | * | 8/1999 | Courtney | 347/92 |
| 5,950,403 | A | | 9/1999 | Yamaguchi et al. | |
| 6,058,984 | A | | 5/2000 | Sato | |
| 6,238,042 | B1 | | 5/2001 | Kobayashi et al. | |

FOREIGN PATENT DOCUMENTS

| | | | | |
|---|---|---|---|---|
| EP | 1142719 A1 | * | 10/2001 | B41J/2/175 |
| JP | 08112905 | * | 5/1996 | B41J/2/175 |

* cited by examiner

*Primary Examiner*—Anh T. N. Vo
(74) *Attorney, Agent, or Firm*—Fay, Sharpe, Fagan, Minnich & McKee, LLP

(57) ABSTRACT

A method of filling ink into a dual chamber ink-jet cartridge for use with an ink-jet printer includes applying a vacuum to the cartridge through a fill hole of the cartridge to substantially eliminate air within an ink absorbing member of the cartridge. The fill hole is sealed and then ink is pressure filled into the cartridge through the fill hole. A vacuum is again applied to the cartridge to substantially eliminate any residual air in the cartridge due to the pressure filling of the ink. The fill hole may be positioned over a free ink chamber or over the ink absorbing member of the cartridge. The vacuum includes applying a negative pressure of about 27.5 in/Hg. The negative pressure is applied at a cycle rate of 5–30 seconds.

29 Claims, 4 Drawing Sheets

PRESSURIZED INK FILLING METHOD FOR DUAL COMPARTMENT INK-JET CARTRIDGE USED IN INK-JET PRINTER

CROSS-REFERENCE TO RELATED APPLICATIONS

This application claims priority from Provisional Application No. 60/239,088 filed on Oct. 6, 2000.

BACKGROUND OF THE INVENTION

This invention relates generally to the ink-jet printing art for ejecting ink droplets on a recording medium, such as paper, and more particularly, to a method of filling ink into an ink tank cartridge for use in an ink-jet type recording apparatus, such as a printer.

In a conventional recording apparatus, ink is supplied to a recording head from an ink tank constructed as a cartridge. A benefit of using an ink cartridge serving as an ink tank is that ink does not smear due to the leakage of ink while refilling new ink or the like. However, undesired air bubbles can easily enter the ink tank during the filling process which cause problems such as ink supply failure.

A cartridge is often divided into multiple chambers, where ink is stored in a porous foam or material positioned over an outlet port in one chamber and free ink is stored in the other chamber. The free ink migrates from its chamber into the foam through an opening providing communication between the two chambers. The foam then controls the flow of ink as it migrates toward the ink outlet port.

It is known to fill an ink cartridge by introducing ink via a vacuum into the porous foam. This filling method is used in an effort to limit the introduction or retention of air bubbles in the ink cartridge. Air trapped in the cartridge adversely impacts the ink supply to the printhead or can mix in the ink resulting in poor printing quality. In addition, entrapped air in the ink cartridge can result in decreased storage or shelf life of the cartridge. Accordingly, alternative methods of filling have been explored but have failed to adequately address the air entrainment issue.

It is desirable to develop a new and improved method of filling ink into an ink tank cartridge to substantially eliminate air within the ink and provide better, more advantageous overall results.

SUMMARY OF THE INVENTION

Generally speaking, the invention relates to a method of filling an ink tank cartridge used for an ink-jet printer.

More particularly, the filling method comprises the steps of applying a vacuum to the cartridge to substantially eliminate air within an ink absorbing member, pressure filling ink into the cartridge, and applying a vacuum to the cartridge to substantially eliminate residual air in the cartridge due to the pressure filling of ink.

The filling method further includes the step of sealing the fill hole of the cartridge.

The filling method further includes the step of degassing the ink prior to pressure filling.

The filling method also includes the step of sealing the cartridge after filling and before applying vacuum to the cartridge.

The present invention advantageously provides an alternative filling method that adequately addresses the air entrapment issue.

The filling method is simple, effective, and can be adapted to fill the ink cartridge through either chamber of a dual chamber type ink cartridge that provides an ink absorbing member in one chamber and stores free ink in the other chamber.

Still other aspects of the invention will become apparent to those skilled in the art upon reading and understanding the following detailed description.

BRIEF DESCRIPTION OF THE DRAWINGS

The invention may take form in certain components and structures, preferred embodiments of which will be illustrated in the accompanying drawings wherein.

DETAILED DESCRIPTION OF THE PREFERRED EMBODIMENTS

Figure 1:
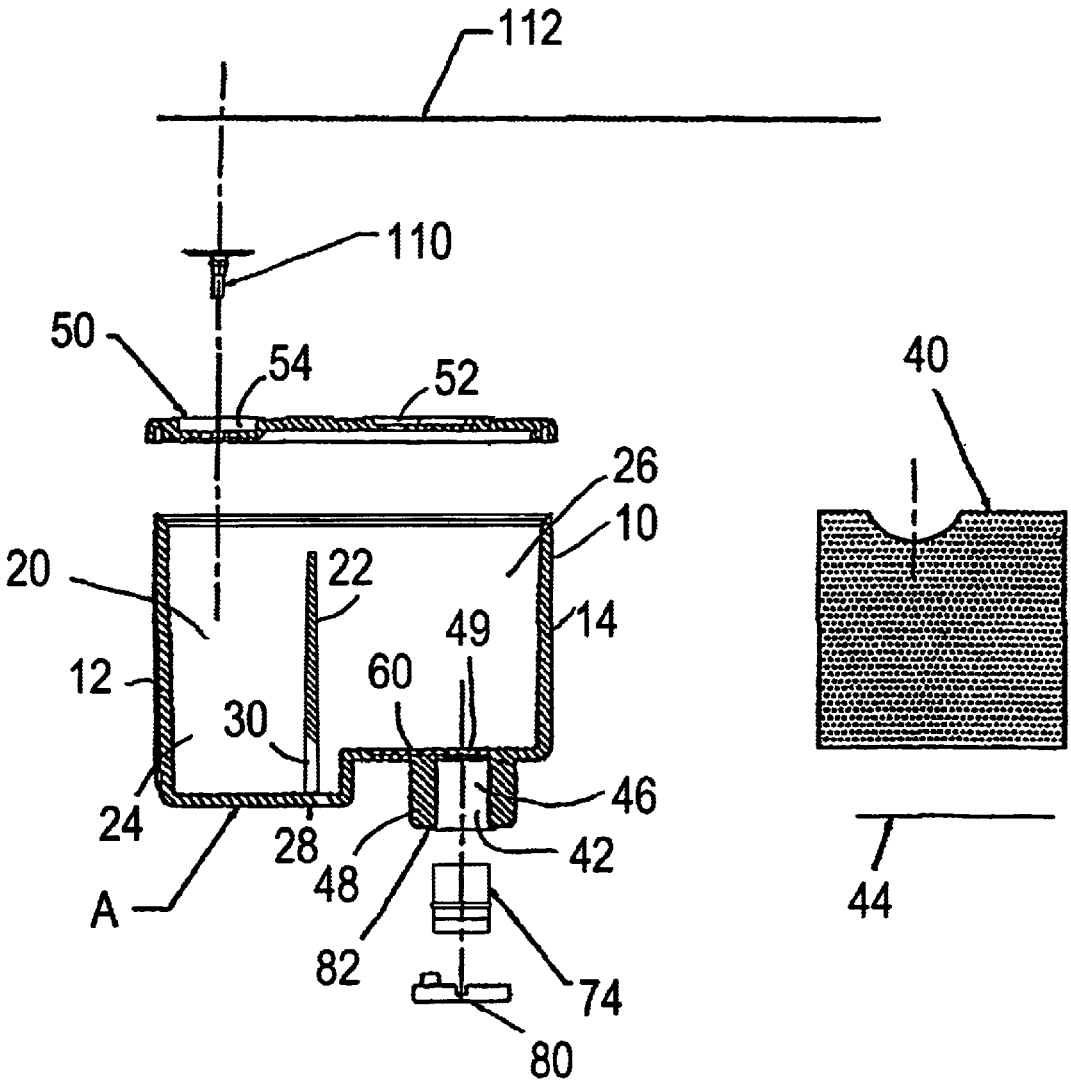
FIG. 1 is an exploded elevational view of an ink cartridge filled according to a preferred embodiment of the present invention.

Referring now to the drawings, wherein the showings are for purposes of illustrating preferred embodiments of the invention only and not for purposes of limiting same, FIG. 1 shows an ink tank cartridge A that is of the type filled according to the filling method of the present invention.

More specifically, the structure of the ink tank cartridge will be initially described for reference purposes. The cartridge has a case or housing 10 defined by a series of walls 12, 14, 16, 18 which form an internal cavity 20 of generally rectangular cross section. A dividing wall 22, that extends laterally between opposed sides of the housing and extends upwardly from a bottom wall 28 to an open top end, separates the housing internal cavity into two chambers 24, 26. Here, the chambers are substantially equally sized, although it will be appreciated that the chambers can be different sizes without departing from the scope and intent of the present invention. An opening 30 is provided through a lower region of the dividing wall 22 adjacent the bottom wall placing the chambers into fluid communication with each other for ink storage and transfer purposes. The chamber 24 stores free ink while chamber 26 stores ink in an ink absorbing or porous member 40.

The ink absorbing member is preferably a porous material or foam and is preferably formed of Melamine™ or hydrophilic foam. It will be appreciated, however, that other materials exhibiting similar properties may be used for storing ink without departing from the scope and intent of the present invention. The absorbing member is disposed in chamber 26 adjacent an outlet port 42 positioned within the bottom wall of the housing. A filter or screen 44 is inserted in the cartridge over the outlet port prior to inserting the absorbing member. The screen is interposed between the ink absorbing member and the outlet port to prevent egress of air bubbles, contaminants, and the like from the cartridge. The outlet port 42 includes an opening 46 through a pipe-like or chimney member 48 which extends from the bottom wall of the housing. The opening 46 is in communication with an opening 49 within the bottom wall.

Figure 2:
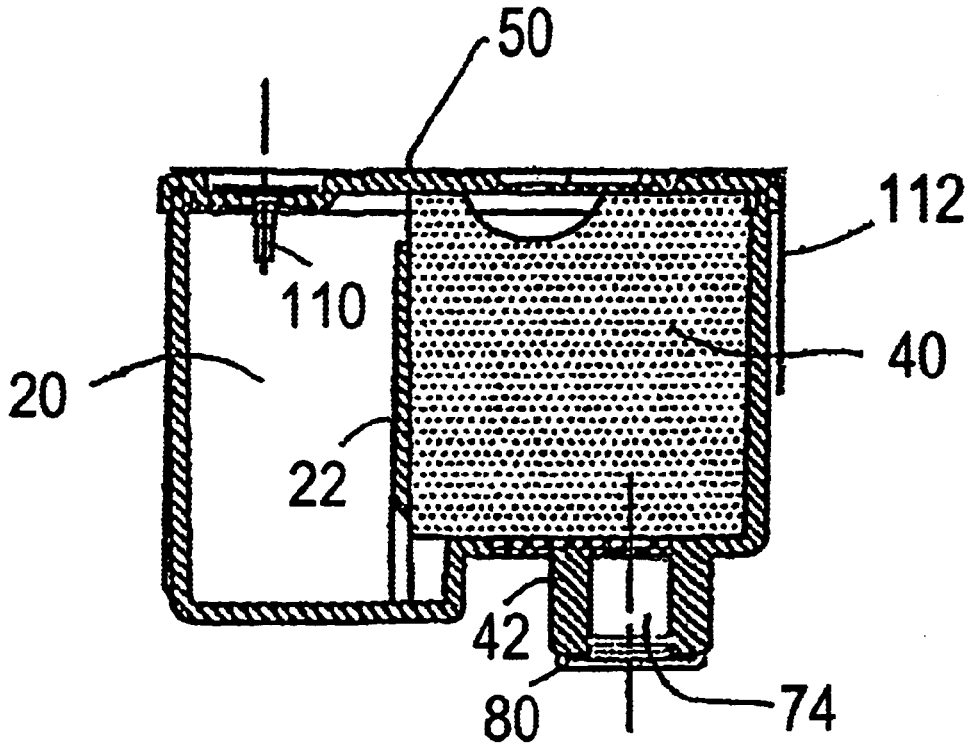
FIG. 2 is a side elevational view in cross section of the ink cartridge of FIG. 1 in an assembled configuration.

Referring to FIG. 2, after the ink absorbing member has been installed and properly positioned in the first chamber, a cover 50 is fixedly secured to the housing, for example, by ultrasonic welding. The cover has a fill hole 52 that is preferably recessed within the cover. The height of the ink absorbing member is slightly less than the inside height of the housing as measured between the bottom wall and the underside of the cover. Thus, there is no compression of the ink absorbing member in the vertical direction. The ink absorbing member has pore sizes which are larger than those in the filter screen and the ink absorbing member may be constructed with a cross-sectional width slightly greater than the chamber of the housing.

The filter screen is preferably mesh and is located over the inner opening of the ink supply port. The filter is thermally sealed over a recessed groove 60 located within the bottom wall, and the groove 60 is used to transfer ink to the ink outlet port. In an alternate construction, the filter screen may be positioned inside a recessed pocket extending into the bottom wall of the housing adjacent the outlet port, and the groove 60 may extend into or along the bottom of the recessed pocket.

A seal member or grommet 74 is inserted into the chimney 48 of the housing through the opening 46. The grommet is generally cup-shaped and has a membrane portion that is pierced upon mounting of the cartridge to the printer. The pierced grommet seals around the printer needle and defines an ink supply or dispensing opening only when and as the cartridge is mounted in a printer.

A grommet retaining ring 80 is placed onto the outer, distal end 82 of the chimney over the grommet and has an enlarged central opening (not shown) to provide access to the grommet and outlet port. Preferably, the grommet retaining ring is secured into place on the chimney such as by ultrasonic welding. Alternatively, the grommet is retained within the chimney by deformation of at least a portion of the distal end of the chimney. The deformed portion of the chimney extends into outlet port 42, and reduces the size of the port thereby preventing the unintentional dislodgment of the grommet. As such, grommet retaining ring 80 is eliminated from the assembly.

The preferred method of filling ink into the cartridge is performed as follows. The cartridge with the sealed cover assembly is placed into a fixture that effects a seal around the fill hole 52 and a negative pressure or vacuum is applied to the cavity through the fill hole via a vacuum source 90 (See FIG. 3). A valve 91 is opened to apply the vacuum to the cartridge. The pre-fill vacuum ranges from 15 in/Hg minimum to a maximum of 30 in/Hg, with a preferred range around 27.5 in/Hg. The vacuum is preferably applied in a cycle time ranging from 5–30 seconds. This pre-vacuum cycling substantially eliminates air from open cells within the ink absorbing member and in the chamber to effectively remove air from the cartridge and maximize the amount of ink that can be stored within the cartridge. Valve 91 is closed at the end of the vacuum process.

Water based ink-jet type ink is degassed prior to filling by a cyclic degassed method. Either black ink or a different color ink, e.g., cyan, magenta, and yellow ink, is introduced into the cavity of the cartridge. Of course, if multiple cavities are provided in the cartridge, inks of different colors can be filled into the different cavities. The ink is preferably injected into the cartridge under pressure by means of a hollow needle 92 extending through the fill hole. For example, the needle is an 18 gauge needle. The ink is introduced under pressure to maximize the amount of ink for consumer end use and minimize the likelihood of air entrapment.

In the preferred arrangement, the area surrounding the fill hole is sealed via a seal or suction cup 94. The needle is inserted through the seal cup into the cartridge and then ink is pressure filled via source 100 at a flow rate of approximately between 0.873 milliliters per second (ml/sec) to 3.26 ml/sec. into the cartridge. Of course other ranges may be used depending on different filling equipment, inks, needle size, cavity dimensions, etc. A valve 102 within the system is opened to allow the ink to flow through the fill hole into the chamber.

Figure 3:
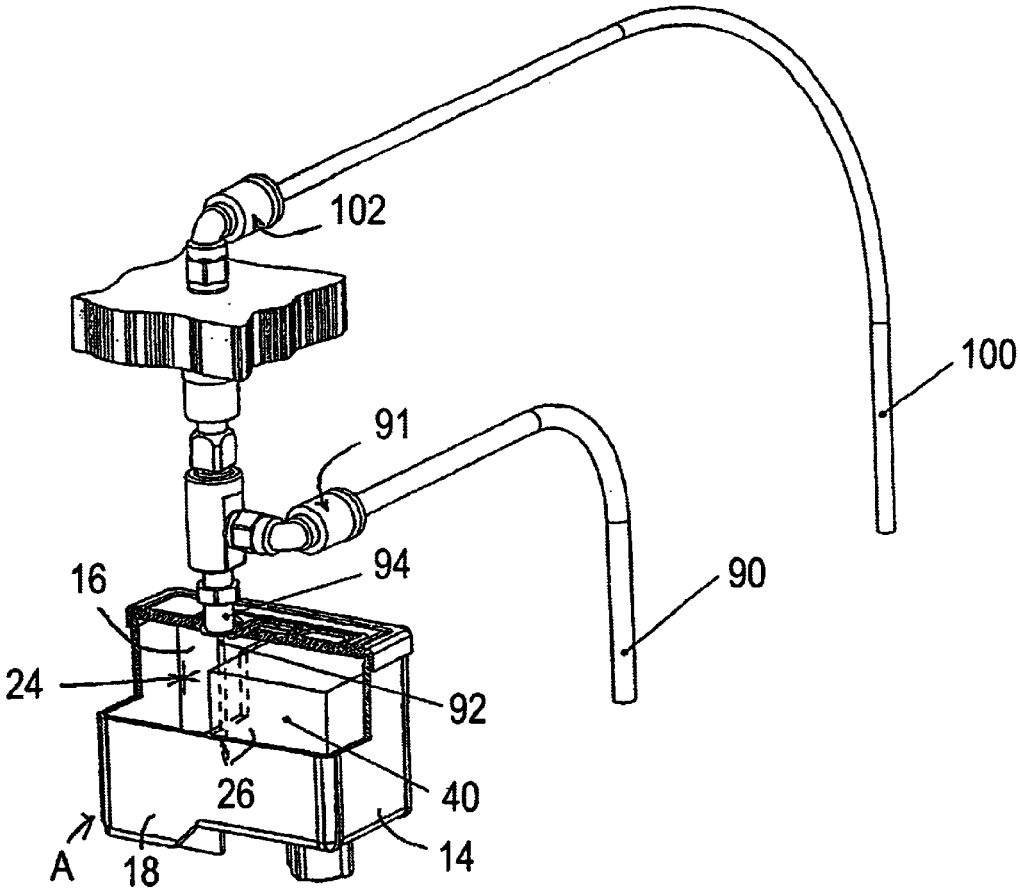
FIG. 3 is a perspective view in partial cross section showing the preferred filling process for the ink cartridge; and, FIG. 4 is a perspective view in partial cross section of the filling process of the ink cartridge in accordance with a second preferred embodiment.
Figure 4:
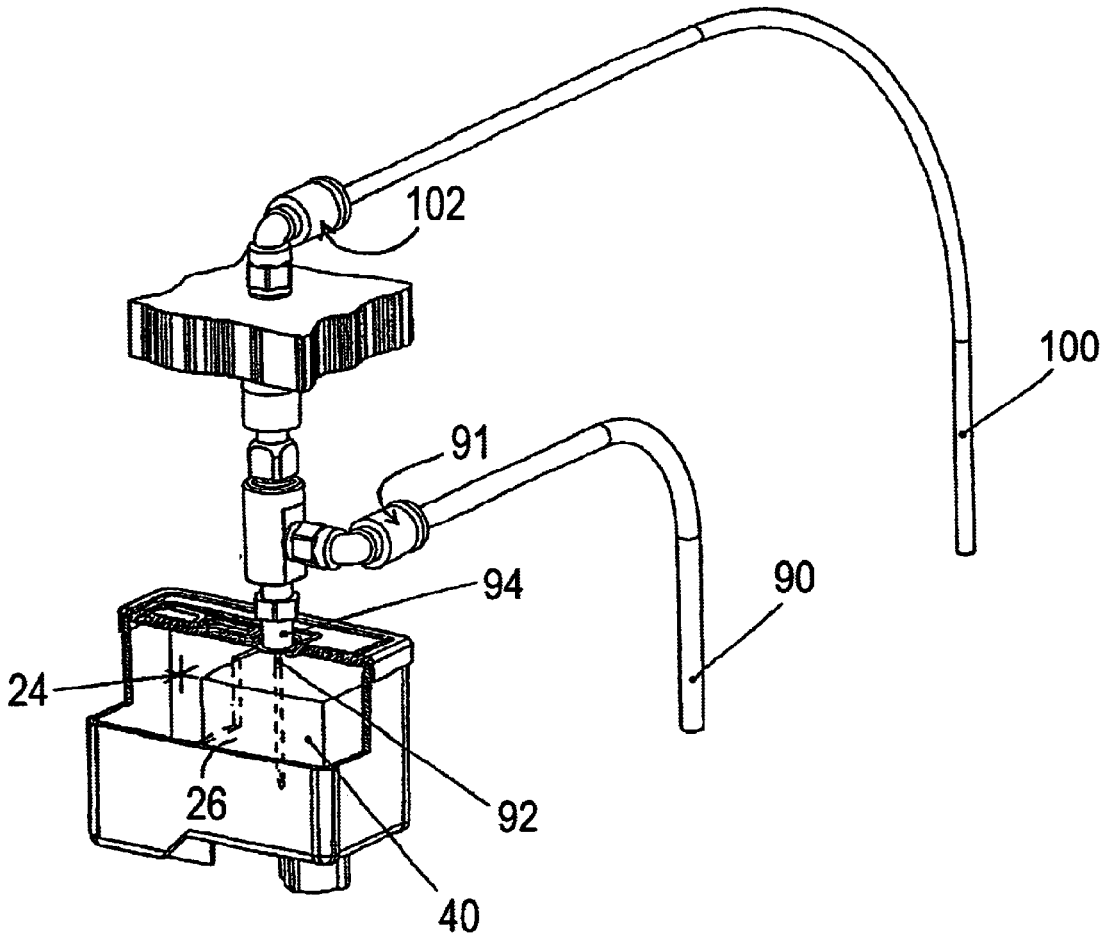

Referring to FIG. 3, the first preferred embodiment fills ink through needle 92 into the free ink chamber 24. Alternately, as seen in FIG. 4, the ink is injected directly into the chamber 26 that includes the porous member 40. It will be appreciated that cover 50 is adapted to engage housing 10 in either of two opposing orientations. In one orientation, as shown in FIG. 3, the fill hole 52 is adjacent the free ink chamber 24. In the other orientation, as shown in FIG. 4, the fill hole is adjacent the chamber including the porous member.

After the desired amount of ink is filled into the cartridge, the valve 102 for ink fill is closed and valve 91 is re-opened to apply a post-fill vacuum to degas the ink. The vacuum is pulled after filling the cartridge with a vacuum pressure in a range between 15 in/Hg minimum to 30 in/Hg maximum, again with the preferred amount being 27.5 in/Hg, or to a pressure greater than that of the ink itself at a cycle time of about 5–30 seconds. This post-fill vacuum removes substantially all residual air within the cartridge created during the pressure filling process. The valve 91 is again closed at the completion of the vacuum process.

The needle and the seal cap are removed from association with the fill hole 52, allowing the negative pressure remaining in the cavity from the post-fill vacuum to return to ambient atmospheric pressure. The fill hole 52 is then sealed by a sealing film 112, and the cartridge is thereafter suitable for packaging.

In an alternate embodiment, the cover 50 includes both a fill hole 52 and a vent passage 54. Retained in the vent passage is a seal for selectively permitting the passage of fluid between the interior and the exterior of the cartridge. The seal is in the form of a check valve 110. However, it will be appreciated that the seal may take the form of any suitable sealing member, including a septum seal plug. The check valve 110 forms a one-way fluid passage between the interior and the exterior of the cartridge, permitting fluid to pass from the interior of the cartridge while preventing any substantial flow of fluid from the exterior to the interior of the cartridge.

Check valve 110 is formed from silicone, though it will be appreciated that any suitable elastomeric material may be used. The check valve is inserted into the fill hole by inserting a stem of the valve into a recessed side of the fill hole. (See FIGS. 1 and 2). The stem of the valve is assembled to the cover such that the enlarged head of the valve covers the entire vent passage and is adapted to maintain the desired pressure in the cartridge.

The method of filling this alternate embodiment of the cartridge includes substantially the same pre-fill vacuum, ink filling, and post-fill vacuum operations as previously discussed. Once the post-fill vacuum operation is completed, the fill port is sealed, such as by extending sealing film 112 across the port. Then, the additional step of generating a negative pressure within the cartridge through the check valve is performed. This step aids in retaining the ink in the cartridge. It will be appreciated that the negative pressure within the cartridge is maintained by the check valve, and may be further maintained by the extension of the sealing film across the check valve. It will be further appreciated that upon installation of the cartridge by a consumer, the removal of the sealing film will expose the fill hole which will act thereafter as a vent passage to aid in the proper dispensing of the ink.

Prior to shipment, the cartridge is preferably covered or shrink-wrapped with an air permeable cellophane type material.

The invention has been described with reference to the preferred embodiments. Obviously, alterations and modifications will occur to others upon a reading and understanding of this specification. For example, the ink cartridge illustrates a fixed dividing wall separating the cartridge into first and second chambers. It will be appreciated that the wall may be an insertable spacer that provides the same function. Likewise, although only a single cavity is illustrated in the drawings for storing a single color, one of ordinary skill in the art will appreciate that multiple cavities housing different colors, if desired, can be filled in accordance with the preferred method. The invention is intended to include all such modifications and alterations insofar as they come within the scope of the appended claims or the equivalents thereof.

Having thus described the preferred embodiments, the invention is now claimed to be:

1. A method of filling ink into an ink-jet cartridge for use with an ink-jet printer comprising the steps of:

providing a cartridge having a plurality of chambers, an ink absorbing member in one of said chambers, a fill hole, an outlet port and a screen extending across said outlet port;

applying a vacuum to said cartridge to substantially remove air from within said ink absorbing member in said cartridge;

filling ink into said cartridge under a positive pressure through said fill hole; and, applying a vacuum to said cartridge from a side of said screen opposite said outlet port to substantially eliminate residual air in at least one of said chambers of said cartridge due to the filling of ink under positive pressure.

2. The method of claim 1, further comprising the step of sealing said fill hole of said cartridge.

3. The method of claim 1, further comprising the step of positioning said fill hole over a free-ink chamber in said cartridge.

4. The method of claim 1, further comprising the step of positioning said fill hole over said ink absorbing member within said cartridge.

5. The method of claim 4, further comprising the step of injecting ink into said ink absorbing member through a needle.

6. The method of claim 1, further comprising the step of degassing the ink prior to pressure filling.

7. The method of claim 1, further comprising the step of sealing the cartridge after filling and before applying vacuum to the cartridge.

8. A method according to claim 1 further comprising steps of releasing residual vacuum within said cartridge to ambient atmospheric pressure, plugging said fill hole, and applying a vacuum to said cartridge from a side of said screen opposite said outlet port.

9. A method of filling ink into a dual chamber ink-jet cartridge for use with an ink-jet printer comprising the steps of:

applying a vacuum to the cartridge to substantially remove air from within an ink absorbing member in said cartridge;

pressure filling ink into said cartridge through a fill hole; and, applying a vacuum having a negative pressure of about 27.5 in/Hg to the cartridge to substantially eliminate residual air in the cartridge due to the pressure filling of ink.

10. The method of claim 9, where the steps of applying a vacuum include applying a negative pressure at a cycle time ranging from 5 to 30 seconds.

11. A method of filling ink into a dual chamber ink-jet cartridge having a fill passage and a vent passage, for use with an ink-jet printer comprising the steps of:

positioning said fill passage of said cartridge over a free ink chamber of said cartridge;

applying a negative pressure of about 27.5 in/Hg to the cartridge through said fill passage to substantially eliminate air within an ink absorbing member of said cartridge;

pressure filling ink into said cartridge through said fill passage;

sealing said fill passage of said cartridge; and, applying a negative pressure to said cartridge through said vent passage to substantially eliminate residual air in said cartridge.

12. A method of filling ink into a dual chamber ink-jet cartridge for use with an ink-jet printer comprising the steps of:

applying a vacuum to the cartridge to substantially remove air from within an ink absorbing member in said cartridge;

pressure filling ink into said cartridge through a fill hole at a flow rate between 0.873 ml/sec and 3.25 ml/sec; and, applying a vacuum to the cartridge to substantially eliminate residual air in the cartridge due to the pressure filling of ink.

13. A method of filling ink into an ink-jet cartridge for use with an associated ink-jet printer, said method comprising the steps of:

a) providing an ink-jet cartridge having a plurality of walls at least partially defining a first chamber containing an ink absorbing member and a second chamber for receiving free ink, a passage extending between said first and second chambers, an outlet port extending through a first wall of said plurality of walls, a screen supported adjacent said first wall and extending across said outlet port, and a fill hole extending through a second wall of said plurality of walls, said screen having a first side facing toward said outlet port and a second side opposite said outlet port, and said second wall being substantially on said second side of said screen;

b) applying a negative pressure to said cartridge through said fill hole from said second side of said screen to evacuate air from within said ink absorbing member;

c) filling a quantity of ink into said cartridge under a positive pressure through said fill hole; and, d) applying a negative pressure to said cartridge through said fill hole from said second side of said screen to evacuate residual air from within at least one of said chambers of said cartridge.

14. A method according to claim 13 further comprising a step of releasing said negative pressure such that said cartridge returns to a substantially atmospheric pressure level.

15. A method according to claim 14, wherein said step of releasing said negative pressure is subsequent to step d).

16. A method according to claim 15 further comprising a step of plugging said fill hole.

17. A method of filling ink into an ink-jet cartridge for use with an associated ink-jet printer, said method comprising the steps of:

a) providing a dual chamber ink-jet cartridge having a plurality of walls at least partially defining a first chamber containing an ink absorbing member and a second chamber for receiving free ink, an ink passage extending between said first and second chambers, an outlet port extending through a first wall of said plurality of walls, a screen supported adjacent said first wall and extending across said outlet port, a fill hole and a vent passage in a second wall of said plurality of walls, said screen having a first side facing said outlet port and a second side opposite said outlet port, and said second wall being substantially on said second side of said screen;

b) applying a negative pressure to said cartridge through said fill hole from said second side of said screen to evacuate air from within said ink absorbing member;

c) filling a quantity of ink into said cartridge under a positive pressure through said fill hole;

d) applying a negative pressure to said cartridge through said fill hole from said second side of said screen to evacuate residual air from at least one of said first and second chambers of said cartridge;

e) releasing said negative pressure such that said cartridge returns to a substantially atmospheric pressure level;

f) plugging said fill hole; and, g) applying a negative pressure to at least one of said first and second chambers of said cartridge through said vent passage from said second side of said screen.

18. A method according to claim 17 further comprising a step of applying a sealing film across said fill hole and said vent passage.

19. A method according to claim 17, wherein said cartridge includes a sealing member sealingly engaging said vent passage.

20. A method according to claim 19, wherein said sealing member is a check valve.

21. A method according to claim 17 further comprising a step of positioning said fill hole over a free-ink chamber in said cartridge.

22. A method according to claim 17 further comprising a step of degassing the ink prior to step c).

23. A method according to claim 17 further comprising a step of positioning said fill hole over said ink-absorbing member within said cartridge.

24. A method according to claim 23 further comprising a step of injecting ink into said ink-absorbing member through a needle.

25. A method according to claim 17 further comprising a step of covering at least a portion of said cartridge in an air permeable cellophane material after step g).

26. A method of filling ink into a dual chamber ink-jet cartridge for use with an associated ink-jet printer, said method comprising the steps of:

a) providing a dual chamber ink-jet cartridge having a first chamber containing an ink absorbing member, a second chamber for receiving free ink, a passage extending between said first and second chambers, a cover having a fill hole over said second chamber, and a vent passage in one of said cartridge and said cover;

b) applying a negative pressure to said cartridge through said fill hole to evacuate air from within said ink absorbing member;

c) filling a quantity of ink into said cartridge under a positive pressure through said fill hole;

d) applying a negative pressure at about 27.5 in/Hg to said cartridge through said fill hole to evacuate residual air from said cartridge;

e) releasing said negative pressure such that said cartridge returns to a substantially atmospheric pressure level;

f) plugging said fill hole; and, g) applying a negative pressure to said cartridge through said vent passage.

27. A method according to claim 26, wherein at least one of steps b), d) and g) include applying said negative pressure at a cycle time ranging from about 5 seconds to about 30 seconds.

28. A method of filling ink into a dual chamber ink-let cartridge for use with an associated ink-jet printer, said method comprising the steps of:

a) providing a dual chamber ink-jet cartridge having a first chamber containing an ink absorbing member, a second chamber for receiving free ink, a passage extending between said first and second chambers, a cover having a fill hole over said second chamber, and a vent passage in one of said cartridge and said cover;

b) applying a negative pressure to said cartridge through said fill hole to evacuate air from within said ink absorbing member;

c) filling a quantity of ink into said cartridge under a positive pressure through said fill hole at a flow rate of from about 0.873 ml/sec to about 3.25 mm/sec;

d) applying a negative pressure to said cartridge through said fill hole to evacuate residual air from said cartridge;

e) releasing said negative pressure such that said cartridge returns to a substantially atmospheric pressure level;

f) plugging said fill hole; and, g) applying a negative pressure to said cartridge through said vent passage.

29. A method of filling ink into a dual chamber ink-jet cartridge for use with an associated ink-jet printer, said method comprising the steps of:

a) providing a dual chamber ink-jet cartridge having a first chamber containing an ink absorbing member, a second chamber for receiving free ink, a passage extending between said first and second chambers, an outlet port, a screen disposed along said outlet port, and a cover having a fill hole over said second chamber, said screen having a first side adjacent said outlet port and a second side opposite said outlet port;

b) applying a negative pressure to said cartridge through said fill hole from said second side to evacuate air from within said ink absorbing member;

c) filling a quantity of ink into said cartridge under a positive pressure through said fill hole;

d) applying a negative pressure to said cartridge through said fill hole from said second side to evacuate residual air from at least one of said first and second chambers of said cartridge; and, e) covering at least a portion of said cartridge in an air permeable polymeric material.

* * * * *